US006857802B2

(12) United States Patent
Chino et al.

(10) Patent No.: US 6,857,802 B2
(45) Date of Patent: Feb. 22, 2005

(54) RECORDING APPARATUS

(75) Inventors: Noriyuki Chino, Kanagawa (JP); Osamu Kanome, Kanagawa (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 10/652,661

(22) Filed: Aug. 28, 2003

(65) Prior Publication Data

US 2004/0041897 A1 Mar. 4, 2004

(30) Foreign Application Priority Data

Aug. 29, 2002 (JP) ..... 2002-251988

(51) Int. Cl.[7] ..... B41J 13/08; B65H 5/02
(52) U.S. Cl. ..... 400/635; 271/193; 271/198
(58) Field of Search ..... 271/193, 198, 271/275; 400/635

(56) References Cited

U.S. PATENT DOCUMENTS 5,531,436 A * 7/1996 Ohyama et al. ..... 271/275
5,631,725 A * 5/1997 Harasawa et al. ..... 399/66
6,332,612 B1 * 12/2001 Kanemura ..... 271/275
6,356,201 B1 * 3/2002 Alles ..... 340/679
6,419,411 B1 * 7/2002 Tanno ..... 400/635
6,652,938 B1 * 11/2003 Nishikawa et al. ..... 428/35.9
6,715,872 B2 * 4/2004 Kanome ..... 347/104

FOREIGN PATENT DOCUMENTS

JP 10301343 A * 11/1998 ..... G03G/15/00

* cited by examiner

*Primary Examiner*—Daniel J. Colilla
(74) *Attorney, Agent, or Firm*—Morgan & Finnegan, LLP

(57) ABSTRACT

To provide a recording apparatus capable of detecting the deterioration of insulation to prevent the damage of a recording head by detecting whether or not there is the current leakage from a surface of a conveyor belt. The inventive recording apparatus includes a conveyor belt for conveying a recording medium comprising a plurality of inner electro-conductive members, a charging section for charging the inner electro-conductive members by a high voltage to attract the recording medium onto the conveyor belt by an electro-static force, a recording head for carrying out the recording on the recording medium attracted onto the conveyor belt, a leakage detection roller for detecting the deterioration of the insulation of the conveyor belt, and a control section for treating the abnormality in accordance with the results detected by the leakage detection roller.

11 Claims, 11 Drawing Sheets

RECORDING APPARATUS

This application claims priority from Japanese Patent Application No. 2002-251988 filed Aug. 29, 2002, which is incorporated hereinto by reference.

BACKGROUND OF THE INVENTION

1. Field of the Invention

The present invention relates to an ink jet recording apparatus, particularly, to a conveying device for the ink jet recording apparatus.

2. Description of the Related Art

There is a type using a recording head of a full-line type in an ink jet recording apparatus, which is capable of recording a high-quality image at a high speed. In this recording apparatus, a method has generally been known in which an electro-static force is generated in a conveyor belt by applying electric charge thereto from electro-conductive electrodes provided in the conveyor belt to attract a conveyed article.

The above-mentioned conveyor device will be described with reference to FIGS. 1 to 3.

As shown in FIG. 1, the conveyor belt is formed of electrode plates 36*a*, 36*b* made of electro-conductive metal, a base layer 36*c*, a surface layer 36*d* and charged members. The charged members and the surface layer 36*d* are made flat and function as insulation layers for insulating the electro-conductive members from outside.

FIG. 2 is an illustration of a conventional apparatus as seen in the lateral direction, and FIG. 3 is a top view thereof.

In FIG. 2, charging means includes a brush 51', an electrode 52' and a support member 53'.

The charging brush 51' is brought into contact with the charged members 36*e* for the purpose of supplying electric charge to the latter. The electric charge is supplied from the charging brush to the electrode plates 36*a* to generate an electro-static force.

The charging means are arranged both on left and right sides to be capable of supplying voltages different from each other; for example, one supplies a plus voltage and the other supplies a minus voltage. Thereby, it is possible to always generate a favorable attracting force.

Also, ink jet recording heads 7K, 7C, 7M and 7Y are arranged above the conveyor belt closer thereto so that an image is formed when a copy is conveyed.

According to such a structure, it is necessary to approach the ink jet recording heads as close as possible to the conveyor belt so that the hitting accuracy of ink dots ejected from the recording heads is improved to obtain a favorable image free from the printing unevenness.

On the other hand, the ink head recording head is not always constituted by materials resistant to a high voltage but may generally be often weak to the static electricity or a high voltage. Thus, since the high voltage is always applied to the conveyor belt, there may be a leakage current between the electro-conductive section of the conveyor belt and the ink jet recording head if the insulation layer of the conveyer belt is damaged during the use due to a wear or a fatigue, resulting in the malfunction of the recording head.

Further, when the conveyor belt having a defect such as a pin hole is continuously used as it is, the damage of the recording head becomes larger to cause the trouble in the printed image.

SUMMARY OF THE INVENTION

To solve the above-mentioned problem, an object of the present invention is to provide a recording apparatus capable of detecting the deterioration of the insulation by knowing whether there is the leakage current from the surface of a conveyer belt to avoid the damage of the recording head beforehand.

According to a first aspect of the present invention, a recording apparatus comprises conveyor means for conveying a recording medium comprising a plurality of inner electro-conductive members, charging means for charging the inner electro-conductive members by a predetermined voltage to attract the recording medium onto the conveyor means by an electro-static force generated due to the charging, a recording head for carrying out the recording on the recording medium attracted onto the conveyor means, an insulation deterioration detecting means for detecting the deterioration of the insulation of the conveyor means, and control means for treating the abnormality in accordance with the results detected by the insulation deterioration detecting means.

The insulation deterioration detecting means may detect the leakage current between the conveyor means and the insulation deterioration detecting means.

The charging means may have a first charging means for charging at least one of the inner electro-conductive members by a first voltage and a second charging means for charging at least one of the others of the inner electro-conductive members by a second voltage, and the insulation deterioration detecting means may determine whether the leakage current is caused by the first voltage or the second voltage.

When the insulation deterioration detecting means detects the current leakage, the control means may stop the driving of the conveyor means.

When the insulation deterioration detecting means determines which of the first and second voltages causes the leakage current, the control means may stop the charging by the charging means corresponding to the leakage current.

When the insulation deterioration detecting means determines which of the first and second voltages causes the leakage current, the control means may lower the charging voltage of the charging means corresponding to the leakage current to a level at which the leakage current is not detected.

The insulation deterioration detecting means may be disposed upstream from the recording head in the conveying direction of the recording medium.

The conveyor means may include a surface insulation layer, and the insulation deterioration detecting means is constituted by an electro-conductive material, wherein a distance between the insulation deterioration detecting means and the surface insulation layer is shorter than a distance between the recording head and the surface insulation layer.

According to a second aspect of the present invention, a sheet conveying device comprises a conveyor belt for conveying a sheet including a first electrode group having a plurality of electrodes arranged in the conveying direction and a second electrode group having a plurality of electrodes, respectively, arranged between every adjacent two electrodes in the first electrode group, charging means for charging the first and second electrode groups at predetermined potentials, respectively, to attract the sheet onto the conveyor belt by an electro-static force generated due to a potential difference between the first and second electrode groups, and detection means for detecting a leakage current from either of the first and second electrode groups.

Control means may be further provided for stopping the drive of the conveyor belt when the detection means detects the leakage current.

Also, control means may be further provided for stopping the charging operation of the charging means when the detection means detects the leakage current.

According to the present invention, it is possible to know a degree of the deterioration of the conveyor belt by providing the means for detecting the leakage current, and even if the leakage current occurs, to stop the conveyor belt before the faulty portion thereof reaches the recording head.

Thus, when the leakage current is detected, it is possible to stop the drive of the conveyor belt to prevent the charged faulty portion thereof from approaching the recording head, whereby the damage of the recording head is avoidable.

Further, by detecting the leakage current caused by the different voltages, respectively, it is possible to determine which electrode leaks. Thereby, even if the faulty portion of the conveyor belt is found, the charging to the electrode corresponding to the faulty portion can be made to stop. As a result, the printing operation can be normally completed without damaging the recording head as well as stopping the apparatus during the printing operation.

Furthermore, even if the leakage current occurs, it is possible to prevent the current from flowing between the recording head and the conveyor belt and, thus, to prolong the life of the conveyor belt.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The present invention will be described below based on the preferred embodiments with reference to the attached drawings.

First Embodiment

Figure 1:
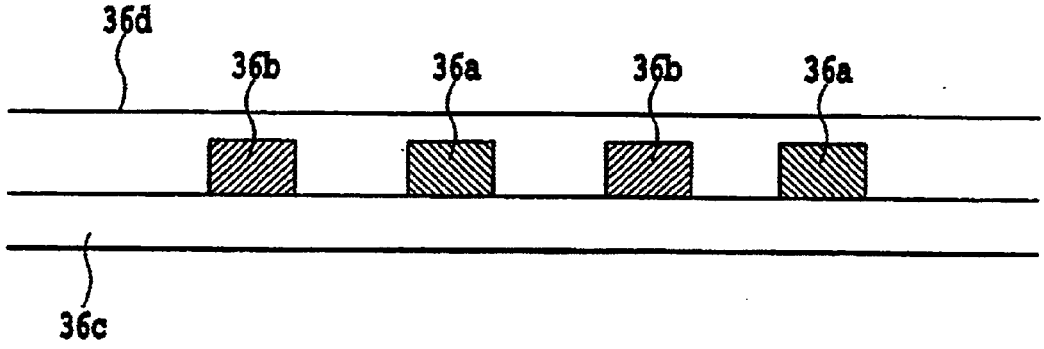
FIG.1 PRIOR ART
FIG. 1 is a sectional view of a conventional conveyor belt.
Figure 2:
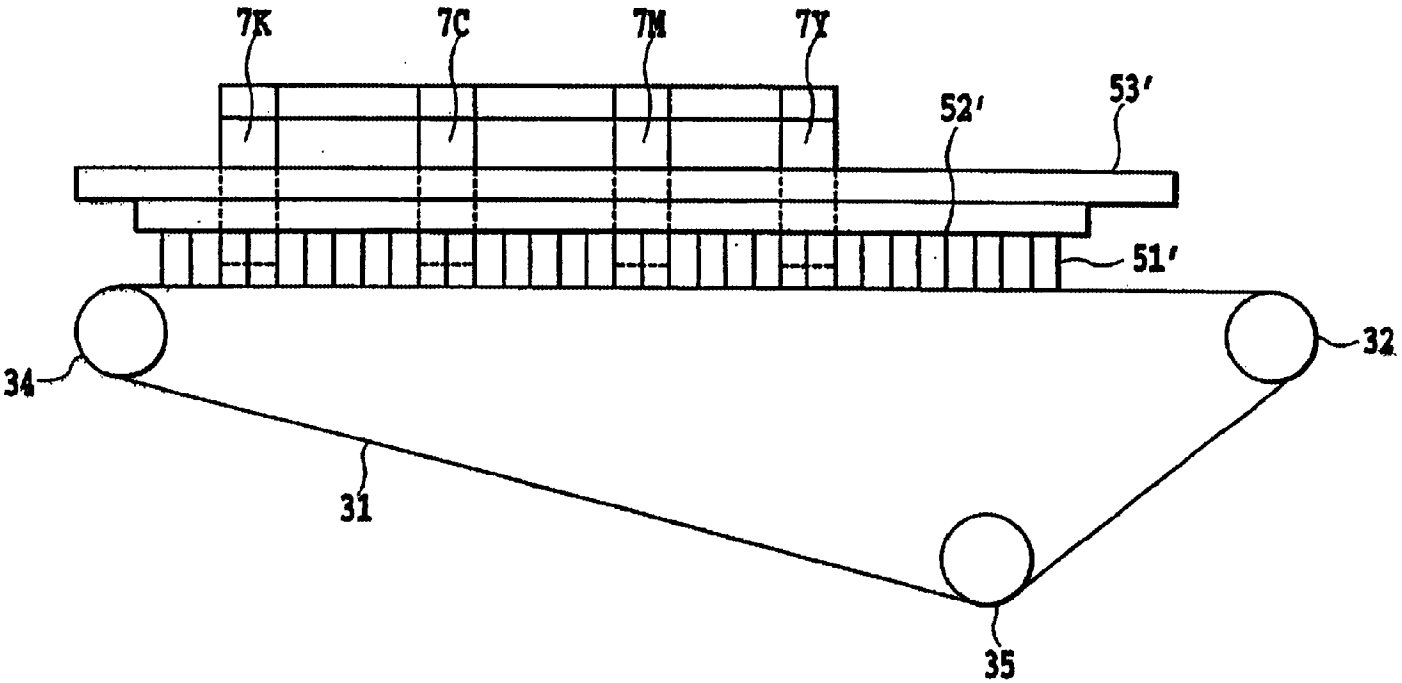
FIG.2 PRIOR ART
FIG. 2 is a side view of a conventional recording apparatus.
Figure 3:
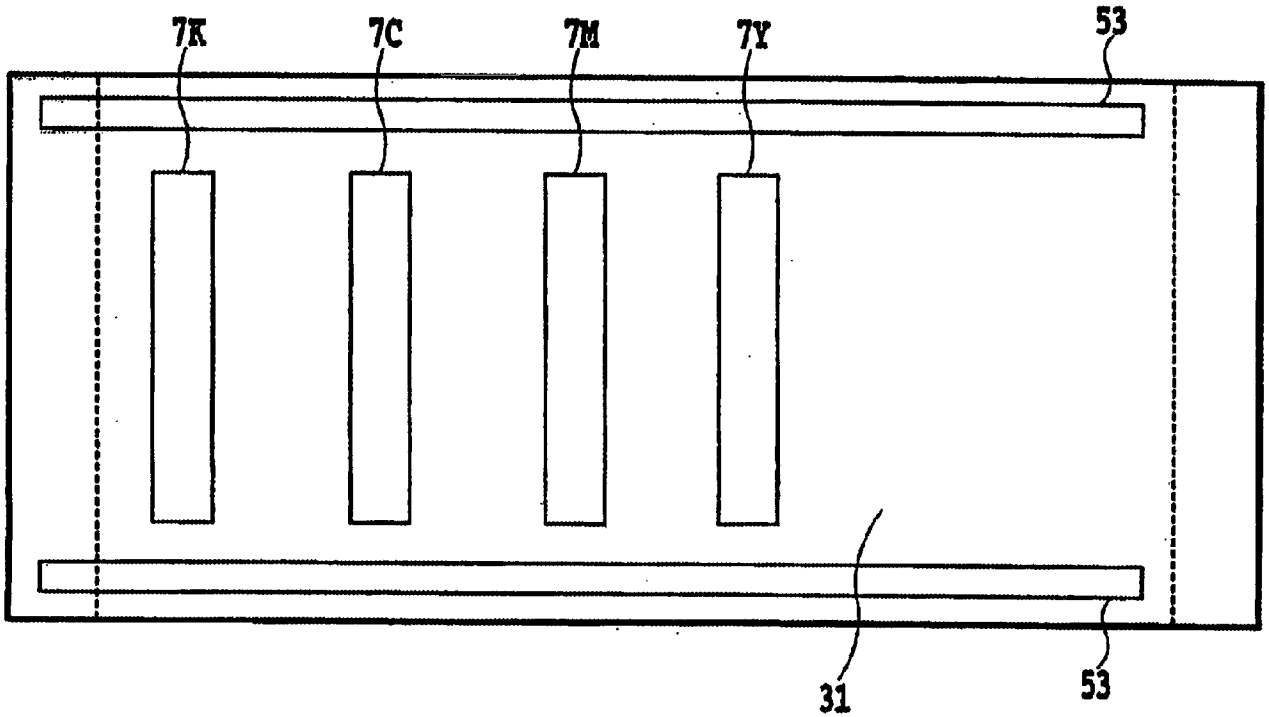
FIG.3 PRIOR ART
FIG. 3 is a plan view of the conventional recording apparatus.
Figure 4:
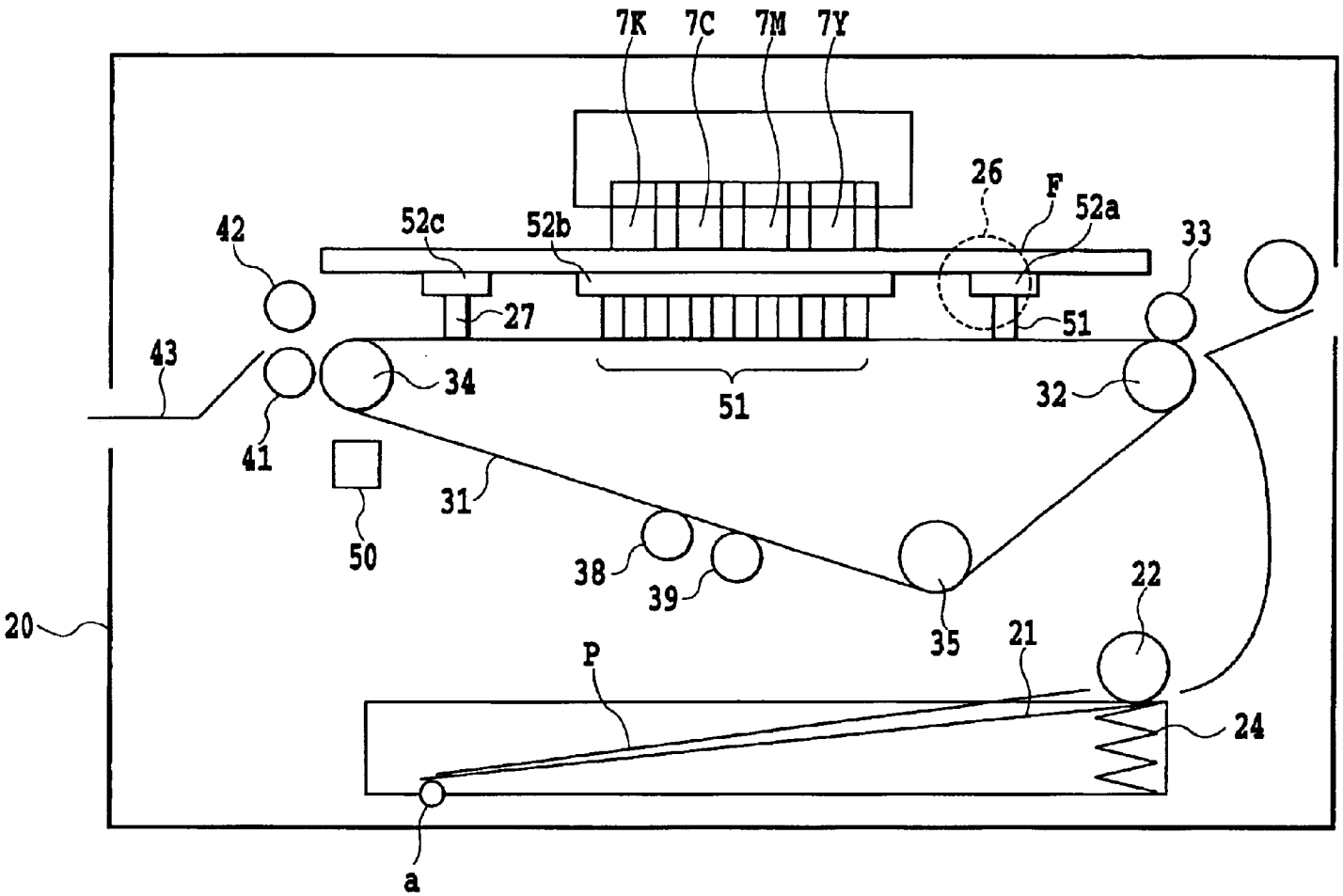
FIG. 4 is an illustration of the entirety of an ink jet recording apparatus according to the present invention.

FIG. 4 illustrates a cross-section of the entirety of a recording apparatus according to the present invention, including a sheet feeding section, a conveyor section, a recording head section and a sheet delivery section described hereinafter.

In the sheet feeding section, a presser plate 21 on which recording sheets P are laid and a feed roller 22 for feeding sheets P are provided. The recording sheet P is biased by a presser plate spring 24 to the feed roller 22 rotatable about a rotary shaft coupled to a base 20. In this state, the recording is carried out on the recording sheet P while the feed roller 22 is rotating. A separation pad not shown having a high frictional coefficient for avoiding the double feed of the recording sheets P and a separation nib not shown for separating the recording sheet are provided in the presser plate 21. Also, a release cam not shown is provided for releasing the contact of the presser plate 21 with the feed roller 22.

According to the above-mentioned structure, the release cam pushed the presser plate 21 downward in a waiting state to release the contact of the presser plate 21 with the feed roller 22. When the driving force of a conveyor roller 32 is transmitted to the feed roller 22 and the release cam via gears or the like in this state, the release cam is apart from the presser plate 21 which then moves upward, whereby the recording sheet P is brought into contact with the feed roller 22 and picked up in accordance with the rotation of the rotating feed roller 22. Thus, the sheet delivery is started. The feed roller 22 continues the rotation until the recording sheet P has been put into the conveyor section.

The conveyor section which is conveying means includes a conveyor belt 31 attracting and conveying the recording sheet P and a PE sensor not shown.

The conveyor belt 31 is driven by a drive roller 34 and wrapped around a conveyor roller 32 and a tension roller 35 which are driven rollers. A drive source of the drive roller 34 is a belt motor 50.

A speed of the belt motor 50 is controllable by control means described later.

The conveyor belt 31 is made of synthetic resin such as polyethylene to have an endless form. Reference numeral F denotes charging means. The charging means applies a voltage, for example, of 3 kV to the conveyor belt to bring the recording sheet P into tight contact with the conveyor belt. This voltage is controlled by high-voltage generating means and high-voltage control means not shown.

The conveyor belt runs at a speed, for example, of 170 mm/sec.

A pinch roller 33 is disposed at a position confronting the conveyor roller 32 and driven by the conveyor belt 31 in contact therewith. Recording heads 7K, 7C, 7M and 7Y are arranged downstream from the conveyor roller 32 in the conveying direction.

The recording head is an ink jet recording head of a line type having the resolution of 600 dpi in which a plurality of nozzles are arranged transverse to the conveying direction. In the recording head, the nozzles are made of Si wafer and an indication member is made of metal such as SUS.

These recording heads are capable of imparting heat to ink by a heater or the like. The ink is film-boiled by this heat, which causes the pressure variation by the expansion or contraction of bubbles due to the film boiling, whereby ink is ejected from the nozzle to form an image on the recording sheet P.

A leakage detection roller 26 is provided as insulation deterioration detecting means between the arrangement position of the conveyor roller 32 and the arrangement position of the recording heads 7K, 7C, 7M and 7Y (upstream from the recording heads). The leakage detection roller 26 is an electro-conductive member made, for example, of metal such as SUS or electro-conductive rubber. If there is a fault such as a pin hole in the conveyor belt 31, a leakage current occurs between the conveyor belt 31 and the leakage detection roller 26. In this regard, a method for detecting the leakage (leakage current) will be described in more detail with reference to FIG. 9.

The sheet delivery section is constituted by a delivery roller 41 and a nip roller 42, in which the recording sheet P on which the image is formed is nipped between the delivery roller 41 and the nip roller 42, conveyed thereby and discharged into a tray 43.

A cleaning rollers 38, 39 are used when it is necessary to clean the belt 31.

An antistatic brush 27 is used for grounding the residual charge on the belt 31 to facilitate the delivery of sheet.

Figure 5:
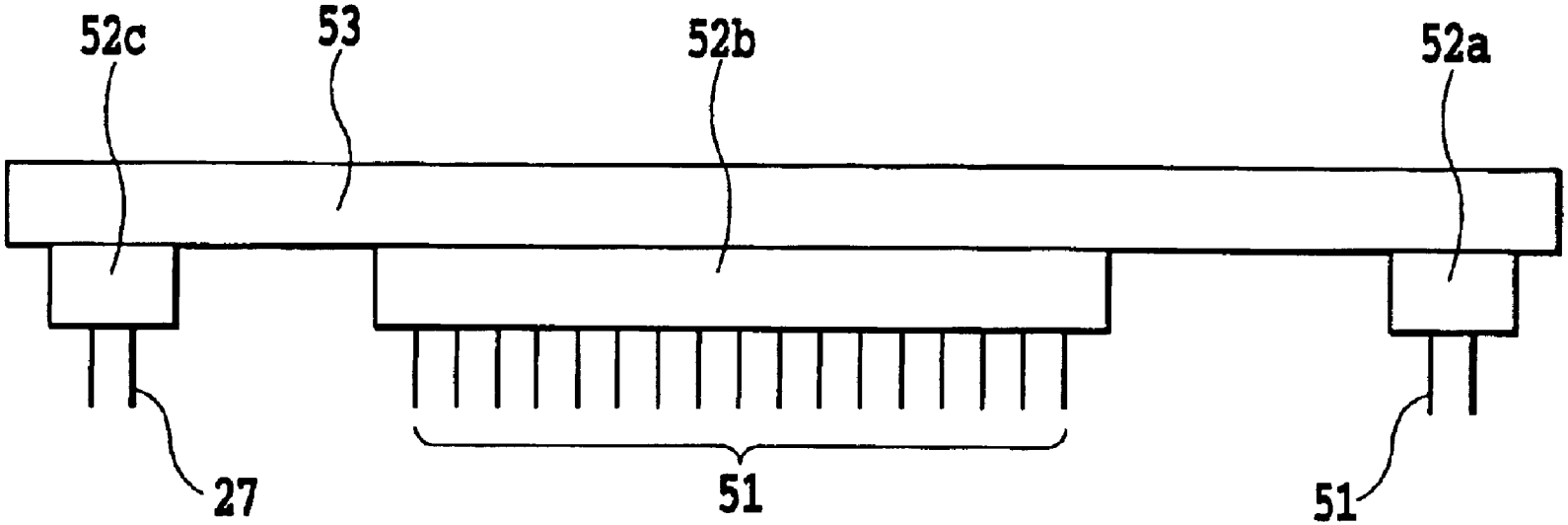
FIG. 5 is an illustration of a charging section according to the present invention.

FIG. 5 is an illustration for explaining charging means according to the present invention.

A plurality of charging means groups arranged in the conveying direction are constituted by a charging brush 51 and a charging electrode 52*a*; a charging brush 51 and a charging electrode 52*b*; and an antistatic brush 27 and a charging electrode 52*c*. The charging electrodes 52*a* to 52*c* are fixed to a support member 53.

The recording sheet is conveyed from a feeding side (right side) to a delivery side (left side).

The charging brush 51 is brought into contact with a charged portion of the belt so that the voltage is applied to the charged portion of the belt. In this drawing, a group of charging electrodes are constituted by charging electrodes 52*a* and 52*c* having the same length in the conveying direction and that 52*b* having a length different from the former.

Concretely, the lengths of the respective electrodes in the conveying direction are 3 cm in 52*a* and 52*c* and 20 cm in 52*b*.

A gap between the respective electrodes is 3 cm. It is necessary that the gap is defined so that two charging brushes are not simultaneously brought into contact with one charged portion. In this regard, a length of the charged portion in the conveying direction is 2 cm.

The electrodes 52*a* and 52*b* are charged by applying a first voltage of +3.0 kV. The voltage applied to the electrode 52*c* is 0 V (grounded).

An area of the central electrode is a place in which the recording is carried out by the recording heads and therefore a powerful attracting force is required. In correspondence thereto, the charging electrode 52*b* is disposed in this area.

The charging electrode 52*a* is a section for supplying a voltage for carrying out the leakage detection, and disposed generally on the same line as the leakage detection roller 26. The charging brush 51 positioned at a tip end of the charging electrode 52*a* is brought into contact with the surface of the belt so that the voltage is supplied via the electrodes 36*c* on the belt. It is enough that the charging electrode 52 and the charging brush 51 are disposed at positions on which a leakage current circuit is formed. To smoothly guide the recording sheet to the sheet delivery section, the destaticization of the conveyor belt 31 is carried out in the charging electrode 52*c*.

While a half of the charging section (the first charging means) provided on one side is solely illustrated in this drawing, there is another half of the charging section (the second charging means) of the same structure not shown. In the latter half of the charging section, a voltage applied to the charging electrodes 52*a* and 52*b* as a second voltage is −3.0 kV and that applied to the charging electrode 52*c* is 0 V (grounded).

Figure 6:
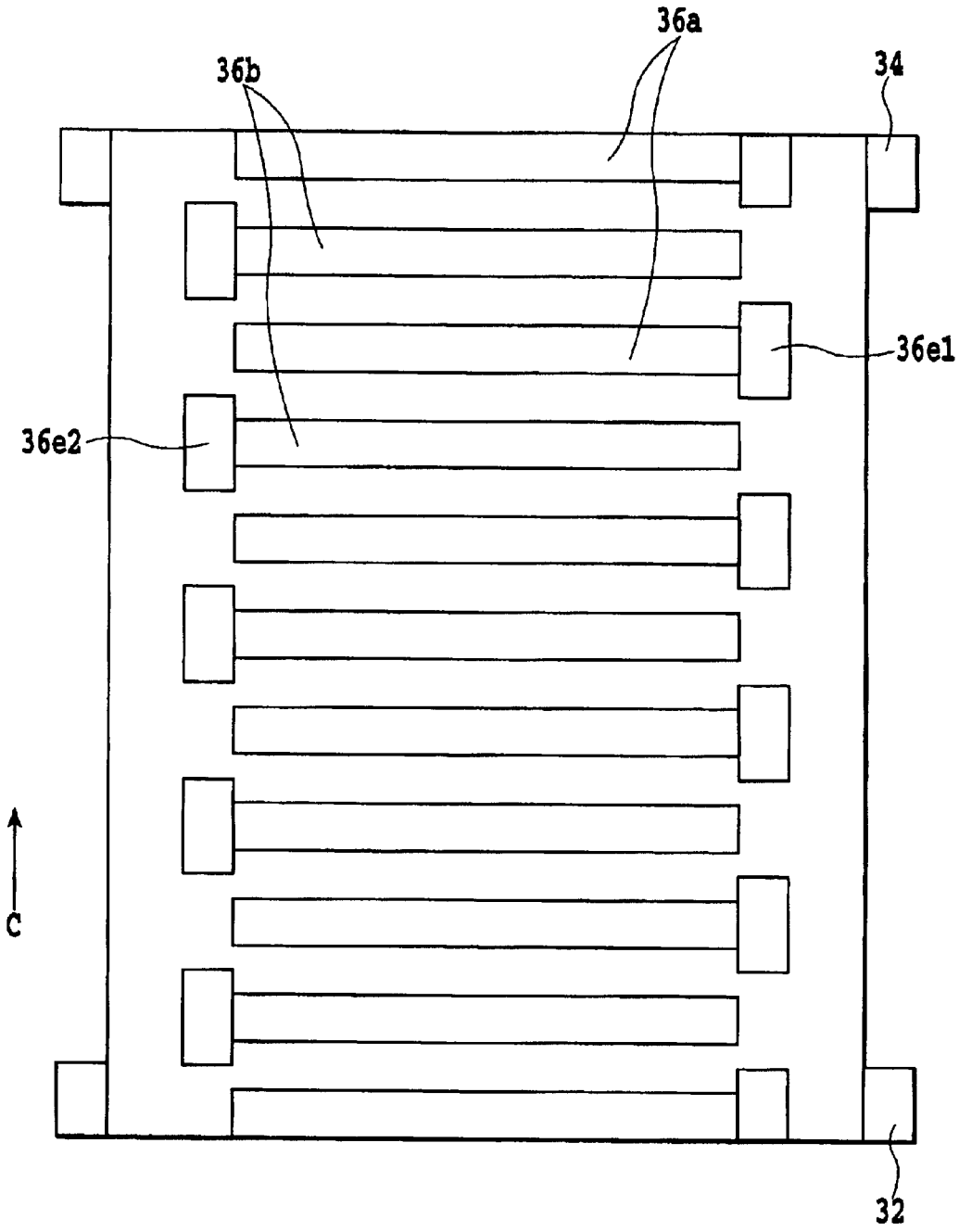
FIG. 6 is a top view of an illustrative conveyor belt for explaining the present invention.

FIG. 6 is an illustration for explaining the conveyor belt 31 and attracting means 36, when the belt is seen from above the recording apparatus. The attracting means is constituted by a plurality of minus electrode plates 36*a* and plus electrode plates 36*b* which are inner electro-conductive members arranged alternately on the conveyor belt 31 like the teeth of a comb to confront each other in the direction vertical to the conveying direction of the belt.

Charged members 36*e*1 and 36*e*2 are arranged on opposite sides of the conveyor belt 31 in the conveying direction of the conveyor belt 31. Each of the charged members 36*e*1 and 36*e*2 projects outside from one end of the electrode 36*a* or 36*b* and is brought into contact with the electro-conductive brush 51 at a predetermined pressure.

By this charging brush 51, the first voltage +3 kV is applied to the charged member 36*e*2 from a high-voltage electric source not shown. Also, the second voltage −3 kV is applied to the charged member 36*e*1. In this regard, the charging brush 51 is preferably made of an electro-conductive material having a volume resistivity of $10^{-4}$, to $10^{-5}$ Ωcm.

Figure 7:
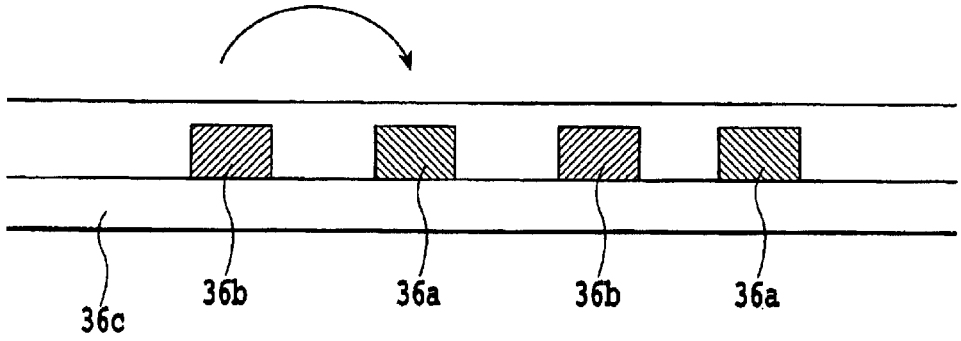
FIG. 7 is an illustration for explaining means for generating an attractive force according to the present invention.

FIG. 7 is an illustration for explaining the generation of attracting force by the attracting means 36.

An electric force is generated as shown by an arrow when the voltage is applied to the minus electrode plates 36*a* (the first electrode group) arranged in the conveying direction in an inner portion of the conveyor belt, and a line of electric force is formed. Due to the potential difference between the minus electrodes 36*a* and the plus electrode plates 36*b* (the second electrode group) arranged between the minus electrodes 36*a*, the attracting force is generated above the conveyor belt 31 to attract the recording sheet P on the conveyor belt.

Since the volume resistivity Ωcm of the base layer is larger than that of the surface layer in the present invention, the line of electric force generated is more powerful on the upper surface of the belt, whereby the attracting force becomes larger.

Figure 8:
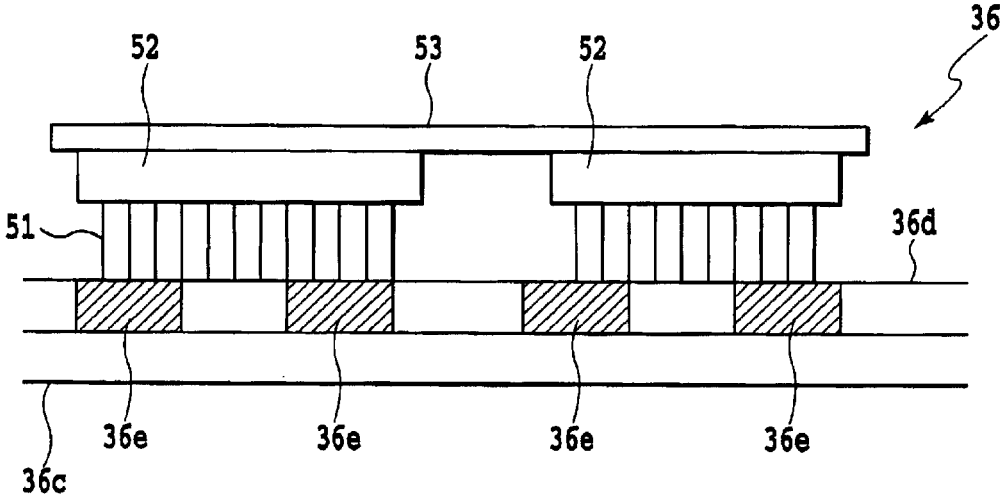
FIG. 8 is an illustration for explaining a charging method according to the present invention.

FIG. 8 is an illustration for explaining the charging from the charging means to the conveyor belt.

The attracting force generating means 36 is constituted by the minus electrode plates 36*a*, the plus electrode plates 36*b*, the base layer 36*c*, the insulated surface layer 36*d*, the charged members 36*e*, the charging brush 51, an electrodes 52 and a support member 53. The charged members 36*e* are flush with the surface layer 36*d*.

The charging brush 51 is brought into contact with the charged members 36*e* at a constant pressure and charges the latter. The minus electrode plates 36*a* and the plus electrode plates 36*b* are protected by the base layer 36*c* and the surface layer 36*d* in a sandwiched manner. The base layer 36*c* and the surface layer 36*d* are made of synthetic resin such as polyethylene, polycarbonate or PVDF having the volume resistivity of $10^{15}$ to $10^{17}$ Ωcm and that of $10^{10}$ to $10^{14}$ Ωcm, respectively.

The minus electrode plates 36*a* and the plus electrode plates 36*b* are also protected by the charged members 36*e* and the base layer 36*c* in a sandwiched manner. The charged members 36*e* are made of electro-conductive synthetic resin containing carbon having the volume resistivity of $10^{-4}$ to $10^{-5}$ Ωcm.

Upper surfaces of the surface layer 36*d* and the charged members 36*e* are subjected to the fluorine resin treatment to have a favorable water-repellency.

Figure 9:
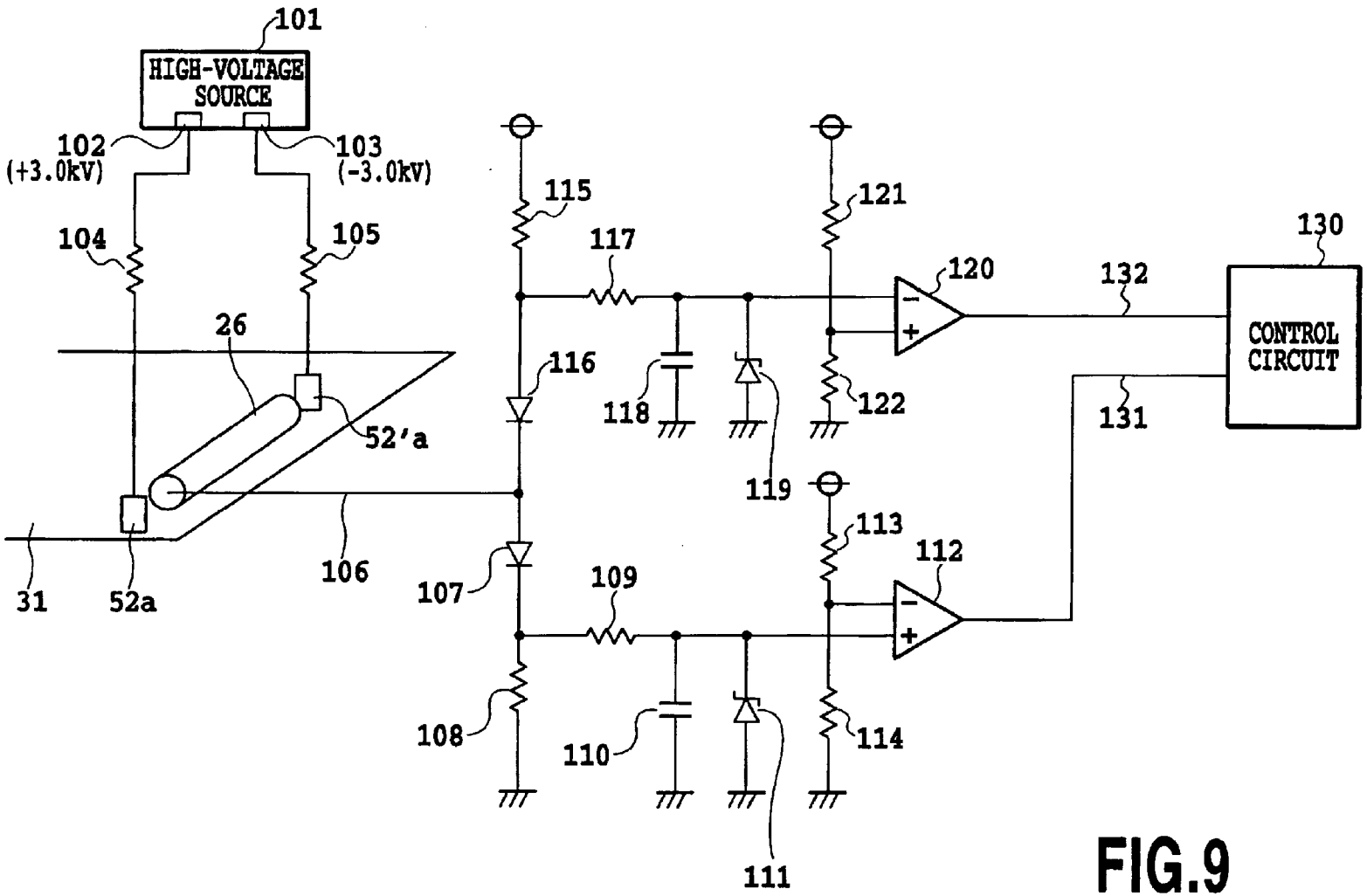
FIG. 9 is an illustration of leakage detection means according to the present invention.

FIG. 9 illustrates a leakage detection circuit.

The charging brush 52*a* disposed above the conveyor belt 31 is connected to a high-voltage electric source 101. The charging brush 52*a* disposed at one end is connected to an output terminal 102 of +3.0 kV via a resistor 104, and the charging brush 52*a*' disposed at the other end is connected to an output terminal 103 of −3.0 kV via a resistor 105, respectively. In such a manner, when the high voltage is applied to the electrodes of the conveyor belt 31 and the apparatus is in a recording state as well as the belt is being driven, the electrode plates protected by the insulating layers are sequentially passes by the leakage detection roller 26. While no accident occurs if the insulation layers are in a normal state, the leakage current occurs between the electrode plates 36*a*, 36*b* and the detection roller 26 when the abnormality occurs in the insulation layers, such as a pin hole due to the fatigue or wear of the belt. To improve the sensitivity for detecting the leakage current for the purpose of preventing the recording head from being damaged, a distance between the leakage detection roller 26 and the conveyor belt 31 is preferably smaller than a distance between the recording head and the conveyer belt 31.

The leakage current flows through a cable 106.

If the leakage current occurs in the electrode plate of +3.0 kV, the leakage current flows through a diode 107 and a resistor 108. While a potential between the diode 107 and the resistor 108 is approximately 2V when no leakage occurs, it exceeds this value if the leakage current flows. Accordingly, it is possible to detect whether or not the leakage occurs by detecting this potential difference. Then, this potential is input to a comparator 112 after a noise is removed by a low-pass filter formed of a resistor 109 and a capacitor 110. A Zener diode 111 is used for the protection. The comparator 112 transmits the information whether or not the leakage occurs obtained in comparison with a threshold value determined by resistors 113 and 114 to a control circuit 130.

Similarly, if the leakage occurs in the electrode plate of −3.0 kV, the leakage current flows through a diode resistor 115 and a diode 116. While the potential difference between the resistor 115 and the diode 116 is approximately 4 V when no leakage occurs, it becomes lower than this value if the leakage current flows. Accordingly, it is possible to detect whether or not the leakage occurs by detecting this potential difference. This potential is input to a comparator 120 after a noise is removed by a low-pass filter formed of a resistor 117 and a capacitor 118. A Zener diode 119 is used for the protection. The comparator 120 transmits the information whether or not the leakage occurs obtained in comparison with a threshold value determined by resistors 121 and 122 to a control circuit 130.

As a result, the control circuit detects the leakage in the electrode plate of +3.0 kV when the input 131 is at a "H" level, while it detects the leakage in the electrode plate of −3.0 kV when the input 132 is at the "H" level.

Figure 10:
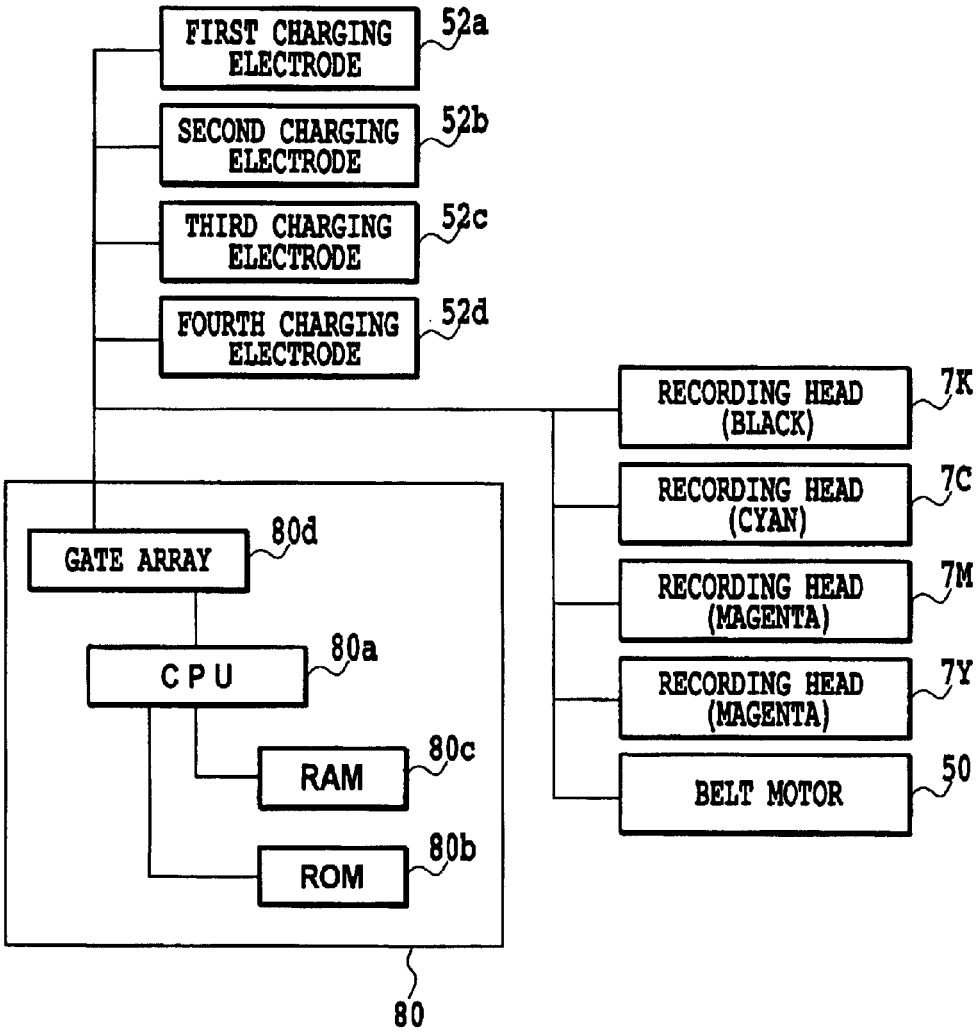
FIG. 10 is a control block diagram according to the present invention.

FIG. 10 illustrates a block diagram for controlling the apparatus according to the present invention.

A control section 80 is constituted by CPU 80*a* operated in accordance with a control program, ROM 80*b* storing the control program and RAM 80*c* which is a memory for saving various memories or data of the operation. A gate array 80*d* is an LSI for controlling signals output to the recording heads or the charging electrodes in association with CPU.

The control section is connected to various devices described below.

A belt motor 50 is a drive source for rotating the conveyor belt. 7K, 7C, 7M AND 7Y are recording heads of black, cyan, magenta and yellow, respectively.

A charging electrode section is constituted by a first charging electrode 52*a*, a second electrode 52*b*, a third electrode 52*c* and a fourth charging electrode 52*d*.

Figure 11:
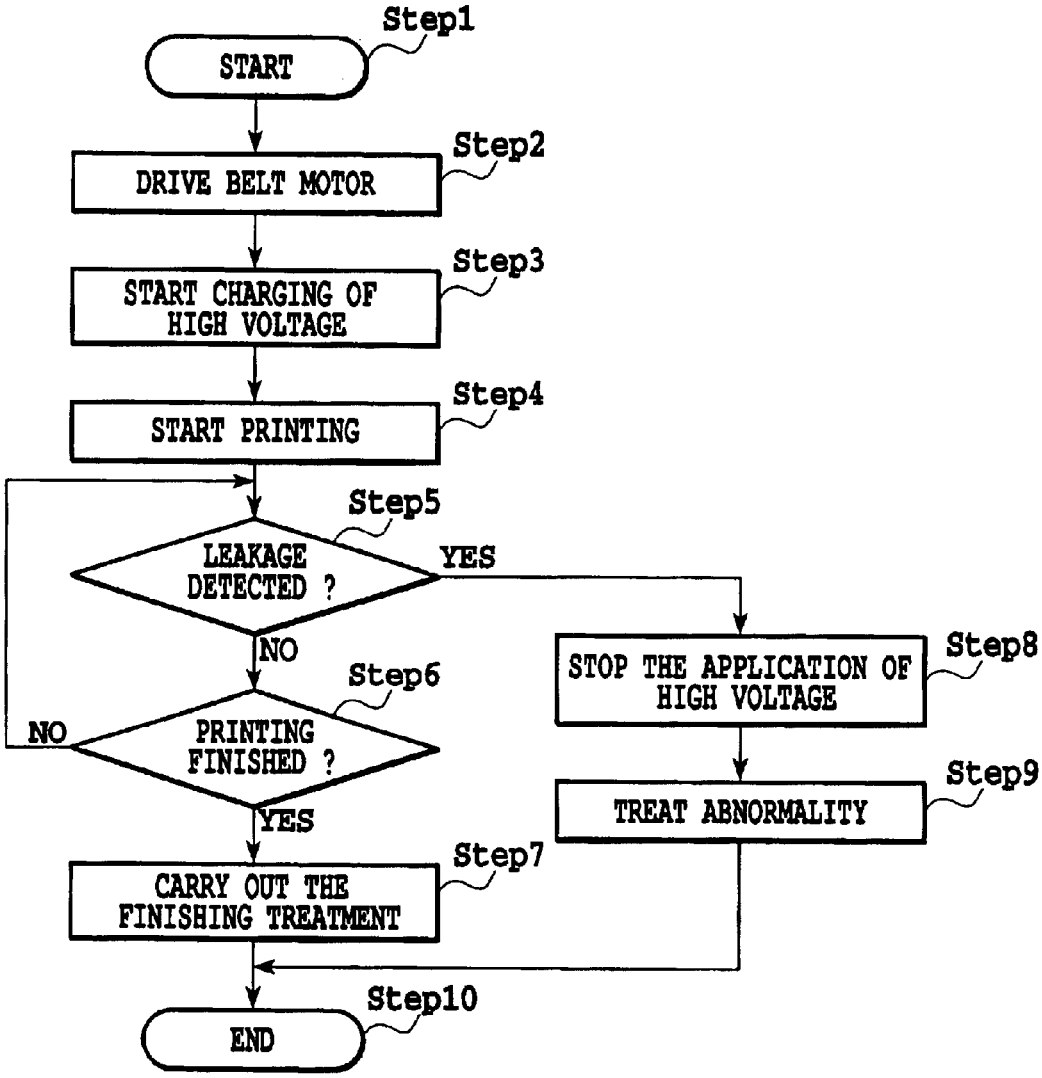
FIG. 11 is a flow chart for explaining a first embodiment of the present invention.

FIG. 11 illustrates an operational flow chart of the control section in a first embodiment.

When the apparatus initiates the recording operation (step 1), the conveyor belt motor is first driven (step 2).

Then, the high voltage is applied to the conveyor belt when the speed of the conveyor belt becomes constant (step 3), and when the attracting force necessary for conveying the recording sheet has been obtained, the recording sheet is conveyed to start the printing operation (step 4).

The control section always carries out the detection of the leakage if any until the printing operation is finished (step 5), and if the printing operation has finished without detecting the leakage (step 6), a usual finishing treatment is carried out (step 7).

If the leakage is detected during the printing operation, the application of the high voltage is immediately made to stop as one of the abnormality treatments and the conveyor belt is also made to stop (step 8). According to these treatments, the leakage portion does not approach the recording head, whereby no leakage occurs between the recording head and the conveyor belt. Thereafter, an abnormality treatment such as displaying information about the occurrence of the leakage (e.g. a service man call) is carried out (step 9). Thus, a series of the treatments are finished (step 10).

Second Embodiment

In the first embodiment, a method is disclosed, for stopping the operation of the apparatus at a time when the leakage is detected. Contrarily, in the second embodiment, another method is disclosed, in which even if the leakage is detected in either one group of the electrode plates, the printing is continued as it is.

Figure 12:
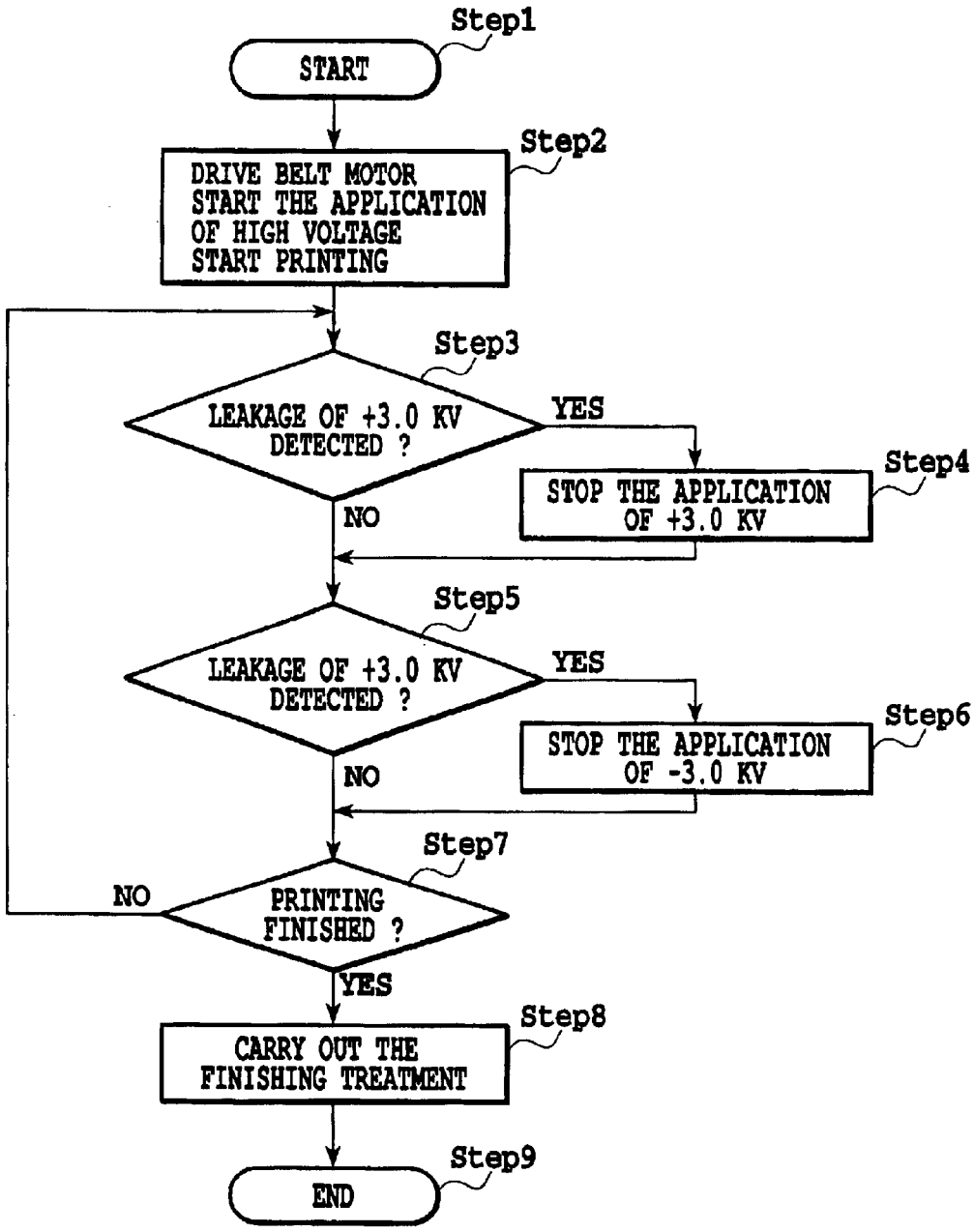
FIG. 12 is a flow chart for explaining a second embodiment of the present invention.

FIG. 12 illustrates an operational flow chart of the control section in the second embodiment.

Upon starting the printing operation (step 1), the conveyor belt motor is first driven.

The high voltage is applied to the conveyor belt when the speed of the conveyor belt becomes constant, and when the attracting force necessary for conveying the recording sheet has been obtained, the recording sheet is conveyed to start the printing operation (step 2).

The control section always carries out the detection of the leakage if any until the printing operation is finished. If the leakage is detected in the voltage charging section of +3.0 kV (step 3), the application of the high voltage of +3.0 kV is made to stop (step 4).

On the other hand, if the leakage is detected in the voltage charging section of −3.0 kV (step 5), the application of the high voltage of −3.0 kV is made to stop (step 6). The printing operation and the leakage detection are alternately repeated in such a manner. When the printing operation has finished (step 7), a usual finishing treatment is carried out (step 8). If the leakage has been detected in either of the voltage charging sections, the situation thereof is output as messages in this finishing treatment.

If the leakage is detected, the charging voltage applied to the voltage charging section corresponding to the leakage may be lowered to a level at which no leakage is detected.

When the leakage is detected in both of the electrode plates, the abnormality treatment identical to that in the first embodiment is carried out. According to these treatments, no leakage occurs in the faulty portion even if the leaked portion approaches the recording heads since the faulty portion is not charged.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A recording apparatus comprising:

a conveyor that conveys a recording medium comprising a plurality of inner electro-conductive members;

a charging unit that charges the inner electro-conductive members by a predetermined voltage to attract the recording medium onto the conveyor by an electrostatic force generated due to the charging, a recording head for carrying out the recording on the recording medium attracted onto the conveyor;

an insulation deterioration detector that detects the deterioration of the insulation of the conveyor; and a controller that treats an abnormality in accordance with the results detected by the insulation deterioration detector.

2. A recording apparatus as defined by claim 1, wherein the insulation deterioration detector detects a leakage current between the conveyor and the insulation deterioration detector.

3. A recording apparatus as defined by claim 2, wherein the charging unit has a first portion that charges at least one of the inner electro-conductive members by a first voltages, and a second portion that charges at least one of the other inner electro-conductive members by a second voltage; and the insulation deterioration detector determines whether the leakage current is caused by the first voltage or the second voltage.

4. A recording apparatus as defined by claim 2, wherein the controller stops the driving of the conveyor means when the insulation deterioration detector detects the current leakage.

5. A recording apparatus as defined by claim 3, wherein the controller stops the charging by the charging unit corresponding to the leakage current when the insulation deterioration detector determines which of the first and second voltages causes the leakage current.

6. A recording apparatus as defined by claim 3, wherein the controller lowers the charging voltage of the charging unit corresponding to the leakage current to a level at which the leakage current is not detected when the insulation deterioration detector determines which of the first and second voltages causes the leakage current.

7. A recording apparatus as defined by claim 1, wherein the insulation deterioration detector is disposed upstream from the recording head in the conveying direction of the recording medium.

8. A recording apparatus as defined by claim 1, wherein the conveyor comprises a surface insulation layer, and the insulation deterioration detector comprises an electro-conductive material, wherein a distance between the insulation deterioration detector and the surface insulation layer is shorter than a distance between the recording head and the surface insulation layer.

9. A sheet conveying device comprising:

a conveyor belt for conveying a sheet including a first electrode group having a plurality of electrodes arranged in the conveying direction and a second electrode group having a plurality of electrodes, respectively, arranged between every adjacent two electrodes in the first electrode group;

a charging unit that charges the first and second electrode groups at predetermined potentials, respectively, to attract the sheet onto the conveyor belt by an electrostatic force generated due to a potential difference between the first and second electrode groups; and a detector that detects a leakage current from either of the first or second electrode groups.

10. A sheet conveying device as defined by claim 9, further comprising a controller that stops the drive of the conveyor belt when the detector detects the leakage current.

11. A sheet conveying device as defined by claim 9, further comprising a controller that stops the charging of the charging unit when the detector detects the leakage current.

* * * * *

UNITED STATES PATENT AND TRADEMARK OFFICE

CERTIFICATE OF CORRECTION

PATENT NO. : 6,857,802 B2
DATED : February 22, 2005
INVENTOR(S) : Chino et al.

It is certified that error appears in the above-identified patent and that said Letters Patent is hereby corrected as shown below:

Column 9,
Line 27, delete “voltages” and insert -- voltage --.

Signed and Sealed this

Tenth Day of May, 2005

JON W. DUDAS
*Director of the United States Patent and Trademark Office*